US006812635B2

(12) United States Patent
Cho et al.

(10) Patent No.: US 6,812,635 B2
(45) Date of Patent: Nov. 2, 2004

(54) CATHODE FOR FIELD EMISSION DEVICE

(75) Inventors: Young Rae Cho, Daejon-shi (KR); Do Hyung Kim, Daejon-shi (KR); Seong Deok Ahn, Daejon-shi (KR); Yoon Ho Song, Daejon-shi (KR); Jin Ho Lee, Daejon-shi (KR); Kyoung Ik Cho, Daejon-shi (KR)

(73) Assignee: Electronics and Telecommunications Research Institute, Daejon (KR)

( * ) Notice: Subject to any disclaimer, the term of this patent is extended or adjusted under 35 U.S.C. 154(b) by 14 days.

(21) Appl. No.: 10/179,739

(22) Filed: Jun. 24, 2002

(65) Prior Publication Data

US 2003/0122467 A1 Jul. 3, 2003

(30) Foreign Application Priority Data

Dec. 28, 2001 (KR) ..... 2001-86834

(51) Int. Cl.[7] ..... H01J 1/62; H01J 63/04

(52) U.S. Cl. ..... 313/495; 313/309; 313/497

(58) Field of Search ..... 313/495, 497, 313/309, 336, 351, 311, 346 R

(56) References Cited

U.S. PATENT DOCUMENTS

| | | | | |
|---|---|---|---|---|
| 5,300,853 A | * | 4/1994 | Watanabe et al. | 313/309 |
| 5,610,471 A | * | 3/1997 | Bandy et al. | 313/309 |
| 5,973,444 A | | 10/1999 | Xu et al. | |
| 6,062,931 A | | 5/2000 | Chuang et al. | |
| 6,239,547 B1 | | 5/2001 | Uemura et al. | |
| 6,277,318 B1 | | 8/2001 | Bower et al. | |
| 6,283,812 B1 | | 9/2001 | Jin et al. | |
| 6,541,906 B2 | * | 4/2003 | Lee et al. | 313/495 |
| 6,605,894 B2 | * | 8/2003 | Choi et al. | 313/495 |
| 2002/0060516 A1 | * | 5/2002 | Kawate et al. | 313/495 |

FOREIGN PATENT DOCUMENTS

| | | |
|---|---|---|
| JP | 2001-052598 | 2/2001 |
| KR | 1999-0058706 | 12/1999 |
| KR | 2001-0058663 | 12/1999 |
| KR | 2001-0068652 | 1/2000 |

OTHER PUBLICATIONS

2001 SID, "Late–News Paper: Thin Film Edge–Emitter Field Emission Flat Panel Display", A. Kastalsky, et al., 3 pages.

2001 SID, "Invited Paper: New Emitter Techniques for Field Emission Displays", J. Kim, et al., 4 pages.

Applied Physics Letters, vol. 79, No. 21, "Operation of a gated field emitter using an individual carbon nanofiber cathode", M. Guillorn, et al., Nov. 19, 2001, 3 pages.

Applied Physics Letter, vol. 75, No. 20, Nov. 15, 1999, "Fully sealed, high–brightness carbon–nanotube field–emission display", W. Choi, et al., 3 pages.

* cited by examiner

*Primary Examiner*—Vip Patel
*Assistant Examiner*—Anthony Perry
(74) *Attorney, Agent, or Firm*—Blakely Sokoloff Taylor & Zafman LLP

(57) ABSTRACT

The present invention relates to a cathode for use in a field emission device. In a triode-type cathode for use in an electron emission device being a core component constituting a field emission device, the present invention includes forming a catalytic layer at the sidewall of a gate hole and then growing an emitter in the catalytic layer, thus uniformly distributing an electric field generated by a voltage applied to a gate electrode over the emitter. Therefore, the present invention can improve the brightness contrast at a low anode voltage and also can control electrons emitted from the emitter only with the gate voltage.

8 Claims, 5 Drawing Sheets

CATHODE FOR FIELD EMISSION DEVICE

BACKGROUND OF THE INVENTION

1. Field of the Invention

The invention relates generally to a cathode for a field emission device, and more particularly to, a cathode for a field emission device capable of controlling the amount of electrons emitted from an emitter using a gate voltage with no regard to an anode voltage.

2. Description of the Prior Art

The field emission device is a core device constituting a cathode in a field emission display. The emission efficiency of the field emission device largely depends on the device structure, the emitter material and the shape of the emitter. Currently, the field emission device can be mainly classified into a diode type having a cathode electrode and an anode electrode, and a triode type having a cathode electrode, a gate electrode and an anode electrode depending on its structure. Materials forming the emitter may include metal, silicon, diamond, diamond-like carbon, carbon nanotube, and the like. Also, materials for forming the diode cathode consist of film or particles (or powder) and may include a diamond or carbon nanotube having a good electron emission characteristic in a low electric field. The diode cathode is disadvantageous in controllability of electron emission and low-voltage driving but is advantageous in the manufacturing process and reliability of electron emission compared to the triode type.

FIG. 1 is a cross-sectional view of a device for explaining a field emission device using a conventional cathode.

Referring now to FIG. 1, a cathode 100 includes a dielectric layer 140 and a gate electrode 150 sequentially formed on a lower substrate 110. A gate hole 170 is formed in a given region of the dielectric layer 140 and the gate electrode 150. Also, a catalytic layer 130 is formed on the lower substrate 110, exposed through the gate hole 170 and the emitter 180 is also formed on the catalytic layer 130.

Meanwhile, an anode plate 195 is located at a position facing the cathode 100 by a given distance. The anode plate 195 has an upper substrate 196 in which an anode electrode 197 and a fluorescent material 198 are stacked.

In the above, the cathode electrode is included in the lower substrate 110. Materials of the lower substrate 110 may include a glass substrate, a silicon wafer, a dielectric substance on which a conductive material is coated, etc. The dielectric layer 140 may be formed by electron beam evaporator or plasma enhanced chemical vapor deposition (PECVD) method. The gate electrode 150 is made of a metal film and may be formed by sputtering or electron beam deposition method. The gate hole 170 may be formed by photolithography process and reactive ion etching (RIE) process. The catalytic layer 130 is formed of a transition metal series. For example, the catalytic layer 130 may be formed of Ni, Fe or Co. The catalytic layer 130 may be formed by sputtering or electron beam deposition method as like in the method of forming the gate electrode 150. The emitter 180 is made of any one of carbon nanotube, carbon nanoparticles and carbon fiber and may be formed by plasma chemical deposition method or thermal chemical vapor deposition method.

An operation of the cathode 100 formed by the above method will be described as follows.

If a voltage (Va) applied to the anode electrode 197 is consecutively increased, electrons are emitted from the emitter 180 even though a voltage (Vg) is not applied to the gate electrode 150. The emitted electrons cause a fluorescent phenomenon while colliding with the fluorescent material 198.

Meanwhile, if the voltage (Vg) is applied to the gate electrode 150, the fluorescent phenomenon can be controlled by a small amount of the voltage (Vg) as the distance between the emitter 180 and the gate electrode 150 is smaller than that between the emitter 180 and the anode electrode 197.

The cathode 100 has a triode cathode structure. Therefore, there is an advantage that the cathode 100 can be controlled by a very small operating voltage compared to the diode cathode. However, in order to obtain a screen having a high brightness, it is required that the gate voltage (Vg) and the anode voltage (Va) be increased simultaneously. Further, in order to obtain a further higher brightness, it is required that the anode voltage (Va) be further increased. In this case, electrons, which are emitted from an edge of the emitter 180 near the gate electrode 150, are controlled by the gate voltage (Vg). However, electrons, which are emitted from a central portion of the emitter 180 relatively far spaced from the gate electrode 150, cannot be controlled by the gate voltage (Vg). Therefore, electrons are only emitted by the anode voltage (Va).

If the anode voltage (Va) is increased in the conventional triode cathode, a high brightness can be obtained but a dark state of the screen could not be implemented, as described above. Therefore, the contrast characteristic of the screen is degraded.

The conventional triode cathode is complicated in structure compared to the diode cathode, but could have a decreased operating voltage. However, if the anode voltage (Va) is increased even when the gate voltage (Vg) is not applied, there is a problem that the amount of the electrons emitted from the emitter 180 could not be controlled by the gate voltage (Vg) since electrons are emitted from the emitter 180.

SUMMARY OF THE INVENTION

The present invention is contrived to solve the above problems and an object of the present invention is to provide a cathode for a field emission device capable of improving the contrast characteristic even at a lower anode voltage and easily controlling electrons emitted from an emitter by a gate voltage, by forming a catalytic layer at the side of a gate hole and growing the emitter in the catalytic layer to distribute a electric field generated by a voltage applied to a gate electrode over all the portions of the emitter.

In order to accomplish the above object, a cathode for use in a field emission device comprising a catalytic layer and a gate electrode formed in a stack structure along with a dielectric layer on a substrate, an emitter, a gate hole exposing the substrate according to the present invention, is characterized in that the emitter is located at the sidewall of the catalytic layer exposed through the gate hole.

In the above, the gate electrode and the catalytic layer are located at opposing sides centering around the gate hole and are located at different heights. The gate electrode located to the substrate nearer than the emitter.

A cathode for use in a field emission device according to the present invention, is characterized in that it a dielectric layer and a catalytic layer stacked on a substrate; a gate hole exposing the substrate; a gate electrode formed at a given region of the exposed substrate; and an emitter formed at the sidewall of the catalytic layer exposed through the gate hole.

The emitter is made of any one of carbon nanotube, carbon nano particles and diamond having defects using carbon as a major component. The catalytic layer is made of one of transition metals such as Fe, Co and Ni or an alloy or a compound of the transition metals. The catalytic layer is used as a cathode electrode. A cathode electrode is further formed between the catalytic layer and the dielectric layer.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF PREFERRED EMBODIMENTS

Figure 1:
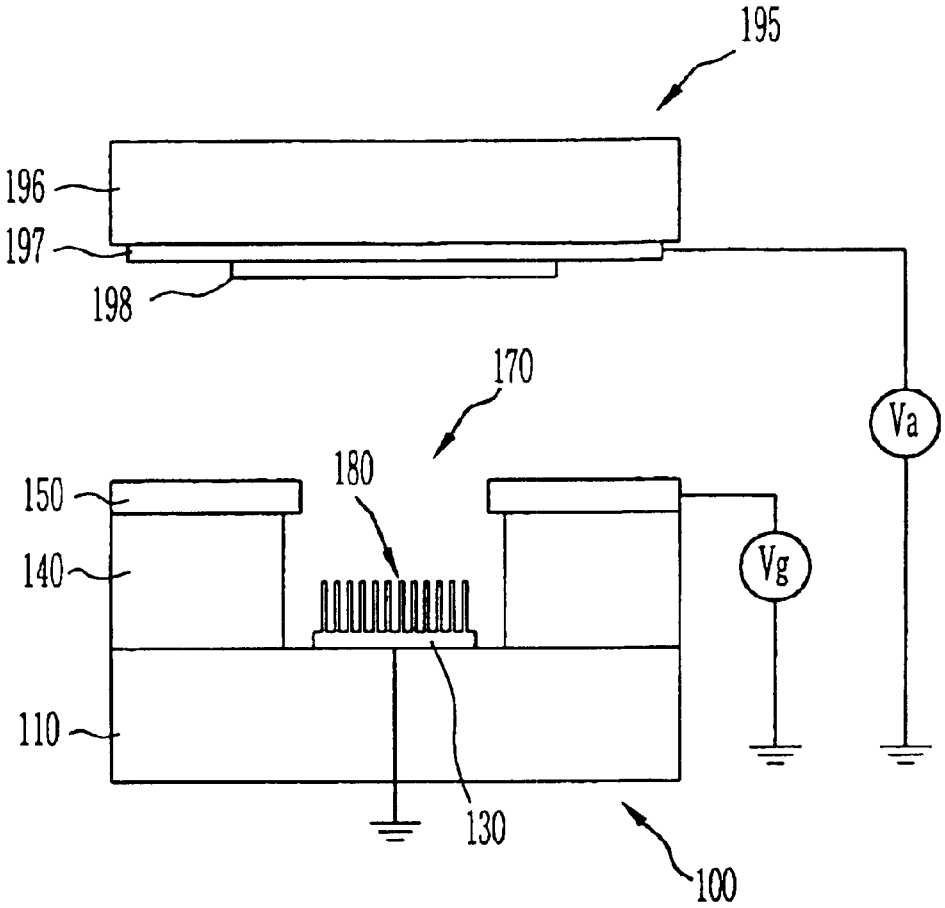
FIG. 1 (PRIOR ART)
FIG. 1 is a cross-sectional view of a device for explaining a field emission device using a conventional cathode.

The present invention will be described in detail by way of a preferred embodiment with reference to accompanying drawings, in which like reference numerals are used to identify the same or similar parts.

The present invention relates to a triode-type cold cathode device used in a field emission display in a cathode for a field emission device.

The significant difference between the present invention and a prior art is that an emitter is grown at the side of a gate hole. Further, the present invention uses a catalytic layer to grow an emitter. At this time, the catalytic layer means a metal or a mixed metal layer where a material for forming the emitter is suitably grown. In the cathode for a field emission device, the emitter must be located only at a desired position. Therefore, the emitter is grown at the lower surface of the gate hole in the conventional triode-type cathode but the emitter is grown at the side of the gate hole in the present invention.

Figure 2:
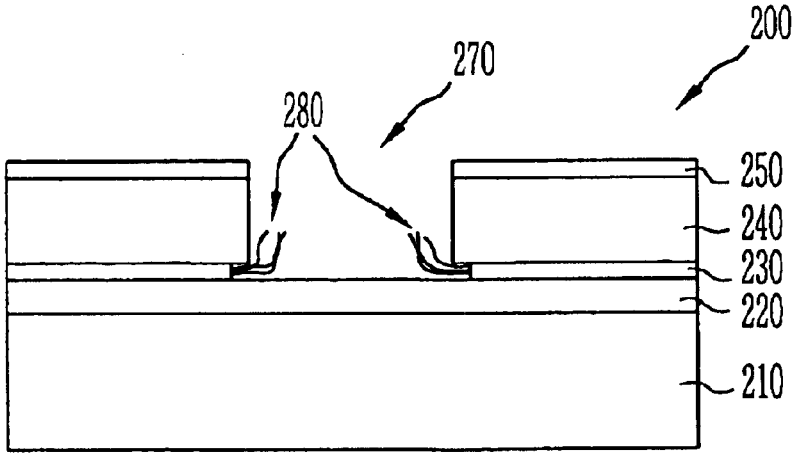
FIG. 2 is a cross-sectional view of a device for explaining a cathode for a field emission device according to a first embodiment of the present invention.

FIG. 2 is a cross-sectional view of a device for explaining a cathode for a field emission device according to a first embodiment of the present invention.

Referring now to FIG. 2, a cathode (200) for a field emission device includes a cathode electrode 220 made of a metal, which is formed in a stripe shape on a lower substrate 210; a catalytic layer 230, a dielectric layer 240 and a gate electrode 250 sequentially stacked on the cathode electrode 220; a gate hole 270 formed in the gate electrode 250, the dielectric layer 240 and the catalytic layer 230, through which the cathode electrode 220 is exposed; and an emitter 280 formed at the side wall of the catalytic layer 230 exposed through the gate hole 270.

In the above, the lower substrate 210 is mainly formed of a glass substrate being an electrically non-conductive material. The cathode electrode 220 is made of a material having a good electrical conductivity and is formed by physical vapor deposition or chemical vapor deposition method. Materials having a good electrical conductivity may include common metal materials.

The catalytic layer 230 may be formed of any one of transition metals such as Fe, Co and Ni, or an alloy or a compound of the transition metals.

The gate hole 270 of a desired size is formed at a given region of the gate electrode 250, the dielectric layer 240 and the catalytic layer 230 by means of photolithography process and dry etching process which are used in the process of manufacturing semiconductor devices. At this time, it is preferred that the dry etching process is a reactive ion etching process.

The emitter 280 may have a tube type, a fiber type, a particle type or a thin film type and is formed at the sidewall of the catalytic layer 230 by means of growth process. In other words, the emitter 280 is formed by depositing any one of carbon nanotube, carbon nanoparticle and diamond having defects containing carbon as a main component, which have a good electrical emission characteristic at a low electrical field by means of plasma chemical vapor deposition or thermal chemical vapor deposition method. Also, the emitter 280 may be formed using ceramic particles, for example, oxide particles, nitride particles, carbide and semiconductor materials.

A method of manufacturing the cathode for the field emission device constructed above according to a first embodiment of the present invention will be below described.

FIG. 3(*a*)~FIG. 3(*d*) are cross-sectional views of devices for explaining a method of manufacturing a cathode for a field emission device according to a first embodiment of the present invention.

Referring now to FIG. 3(*a*), the cathode electrode 220, the catalytic layer 230, the dielectric layer 240 and the gate electrode 250 are sequentially formed on the lower substrate 210. Then, the photoresist film 260 is formed on the gate electrode 250.

In the above, the lower substrate 210 is formed of a glass substrate being a flat dielectric. The cathode electrode 220 and the gate electrode 250 are made of any one of Mo, Ti, W, Ni, Cr and Pt or an alloy or a compound of them. The cathode electrode 220 and the gate electrode 250 are formed by sputtering or electron beam vapor deposition method. The catalytic layer 230 is made of any one of the transition metals such as Fe, Co and Ni or an alloy or a compound of them. The dielectric layer 240 is made of either silicon oxide ($SiO_2$) or nitride ($SiN_x$) and is formed by plasma vapor deposition or electron beam vapor deposition method. The emitter 280 grown from the sidewall of the catalytic layer 230 is formed by growing any one of carbon nanotube, carbon nanoparticle and diamond having defects, which contain carbon as a main component by means of plasma chemical vapor deposition or thermal chemical vapor deposition method.

Referring now to FIG. 3(*b*), a given region of the photoresist film 260 is removed by lithography process and etching process to expose a portion of the gate electrode 250 where the gate hole will be formed.

By reference to FIG. 3(*c*), the gate electrode 250, the dielectric layer 240 and the catalytic layer 230 at a region from which the photoresist film 260 is removed are removed by etching process, thus forming the gate hole 270. Thereby, the cathode electrode 220 is exposed through the gate hole 270.

Figure 3A:
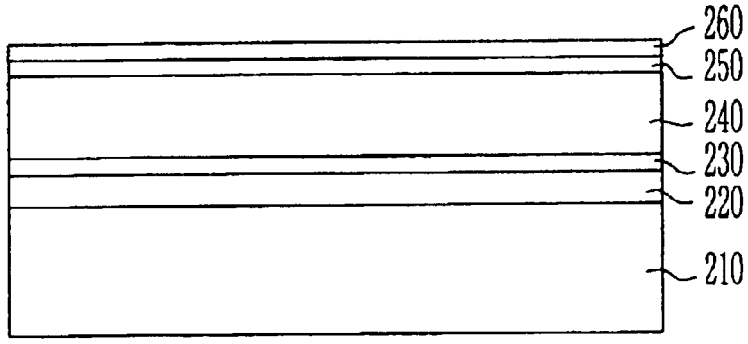
FIG. 3(*a*)~FIG. 3(*d*) are cross-sectional views of devices for explaining a method of manufacturing a cathode for a field emission device according to a first embodiment of the present invention.
Figure 3B:
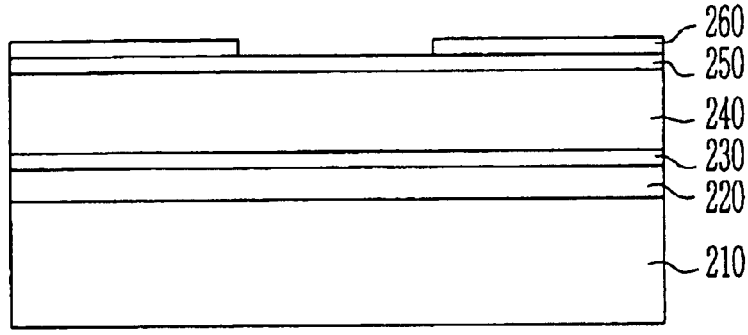
Figure 3C:
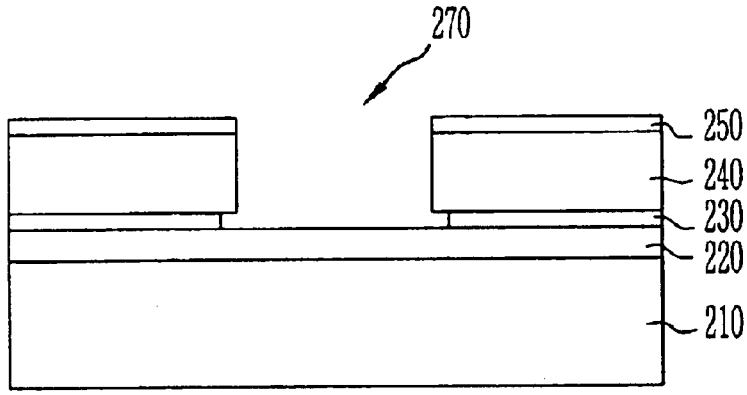
Figure 3D:
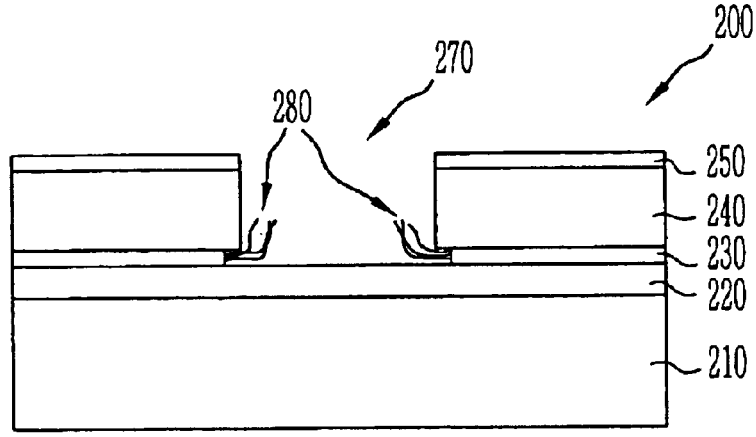

Referring now to FIG. 3*d*, the emitter 280 is formed at the sidewall of the catalytic layer 230 exposed through the gate hole 270. At this time, the emitter 280 is characterized in that it is grown from the sidewall of the catalytic layer 230 and is protruded from the gate hole 270, thus completing the cathode 200 having a triode-type structure.

Thereafter, an anode plate (not shown) is positioned while facing the cathode 200 by a given distance, thus completing a triode-type field emission device.

The cathode for the field emission device according to the present invention is not limited to the above description but may be formed in several similar structures.

Next, a cathode for a field emission device according to another embodiment of the present invention will be now described.

FIG. 4~FIG. 8 are cross-sectional views of devices for explaining a cathode for a field emission device according to another embodiments of the present invention.

A cathode for a field emission device according to a second embodiment of the present invention will be below described by reference to FIG. 4.

Figure 4:
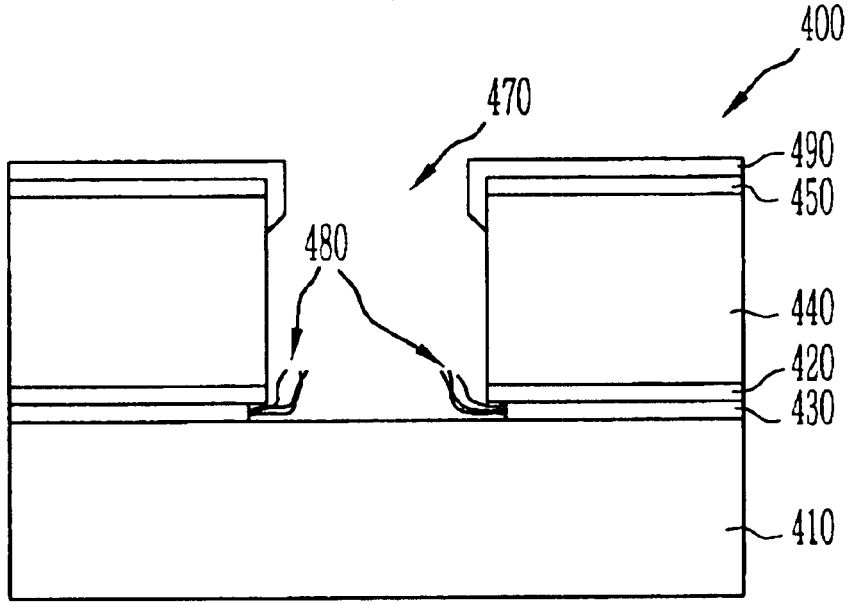
FIG. 4~FIG. 8 are cross-sectional views of devices for explaining a cathode for a field emission device according to another embodiments of the present invention.

Referring now to FIG. 4, a catalytic layer 430, a cathode electrode 420, a dielectric layer 440 and a gate electrode 450 are sequentially stacked on a lower substrate 410. A buffer layer 490 is coated on the gate electrode 450. Upon etching process of forming a gate hole 470, the cathode electrode 420 and the catalytic layer 430 as well as the buffer layer 490 and the dielectric layer 440 are etched to expose the surface of the lower substrate 410 at the lower side of the gate hole 470. An emitter 480 is formed at the sidewall of the catalytic layer 430 exposed through the gate hole 470, thus completing the cathode 400 for a field emission device according to a second embodiment of the present invention.

In the above, the reason why the buffer layer 490 is coated on the gate electrode 450 is that the emitter 480 grown from the catalytic layer 430 prevents shorting with the gate electrode 450. At this time, the buffer layer 490 formed on the gate electrode 450 is formed of silicon oxide ($SiO_2$) or nitride ($SiN_x$) such as the dielectric layer 440.

As shown in FIG. 4, the cathode 400 for the field emission device according to another embodiments of the present invention has the catalytic layer 430 formed on the lower substrate 410 and the cathode electrode 420 formed thereon. In other words, unlike the cathode shown in FIG. 2, the cathode electrode 420 is located on the catalytic layer 430 because the catalytic layer 430 is deposited before the cathode electrode 420. The cathode electrode 420 serves as a conductive material for supplying a voltage applied from an external power supply (not shown) to the emitter 480.

A cathode for a field emission device according to a third embodiment of the present invention will be below described by reference to FIG. 5.

Figure 5:
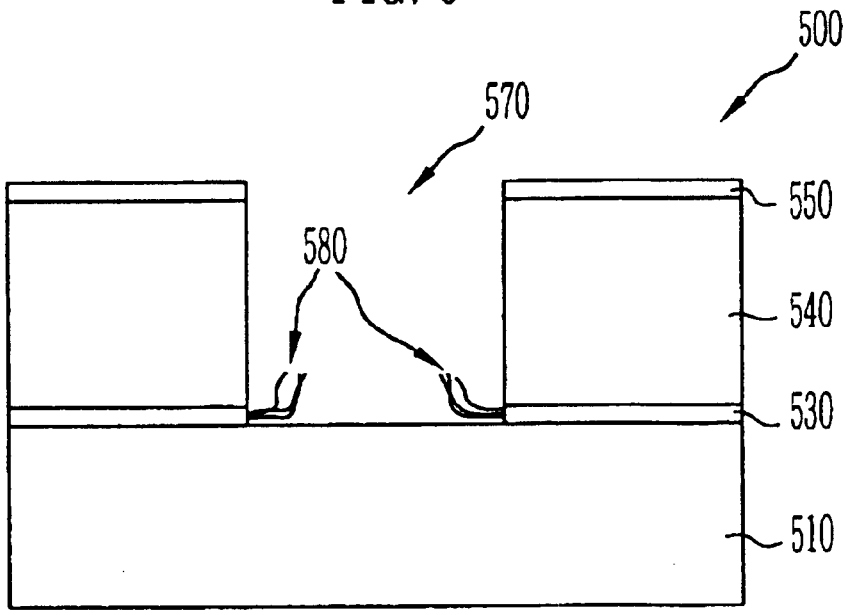

A cathode 500 shown in FIG. 5 employs the catalytic layer 530 as the cathode electrode.

Referring now to FIG. 5, a catalytic layer 530, a dielectric film 540 and a gate electrode 550 are sequentially stacked on the lower substrate 510. Upon etching process of forming a gate hole 570, the gate electrode 550, the dielectric layer 540 and the catalytic layer 530 are etched to expose the lower substrate 510 at a lower side of the gate hole 570. An emitter 580 is formed at the sidewall of the catalytic layer 530 exposed through the gate hole 570, thus completing the cathode 500 for a field emission device according to a third embodiment of the present invention.

In the above, the catalytic layer 530 is formed of a material having an electrical conductivity so that the catalytic layer 530 serves as a cathode electrode. Therefore, in the cathode 500 for the field emission device according to a third embodiment of the present invention, additional cathode electrode is not formed.

At this time, the catalytic layer 530 is formed of any one of the transition metals such as Fe, Co and Ni or an alloy or a compound of them and is formed in thickness of 20 nanometer (nm)~5 micron.

A cathode for a field emission device according to a fourth embodiment of the present invention will be below described by reference to FIG. 6.

Figure 6:
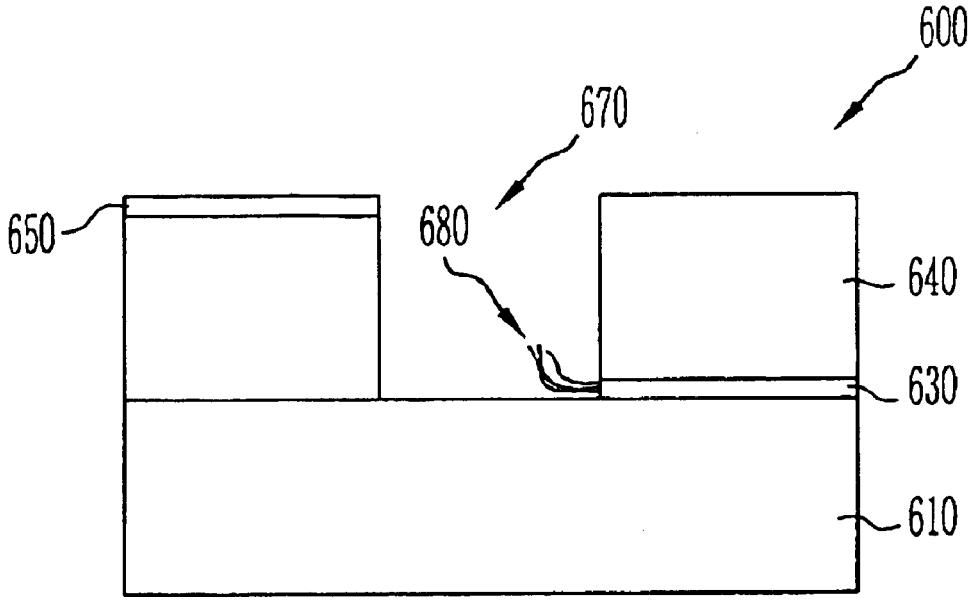

Referring now to FIG. 6, the cathode has a catalytic layer 630 and a dielectric layer 640 sequentially stacked on one side of a lower substrate 610 and a dielectric layer 640 and a gate electrode 650 sequentially stacked on the other side of the lower substrate 610, centering around the gate hole 670. Also, an emitter 680 is formed at the sidewall of the catalytic layer 630, thus completing the cathode 600 for the field emission device according to a fourth embodiment of the present invention.

In other words, the catalytic layer 630 is formed at one side of the lower substrate 610 centering around the gate hole 670 and the gate electrode 650 is formed at the other side of the catalytic layer 630 centering around the gate hole 670. The catalytic layer 630 is formed of any one of the transition metals such as Fe, Co and Ni or an alloy or a compound of them and is used as the cathode electrode, as shown in FIG. 5. Meanwhile, the gate hole 670 may have a given shape, preferably cylindrical or rectangular.

As such, the cathode 600 for the field emission device according to a fourth embodiment of the present invention has a structure in which the emitter 680 and the gate electrode 650 are facing each other with the gate hole 670 intervened. Thus, generation of a leakage current between the emitter 680 and the gate electrode 650 can be minimized.

A cathode for a field emission device according to a fifth embodiment of the present invention will be below described by reference to FIG. 7.

Figure 7:
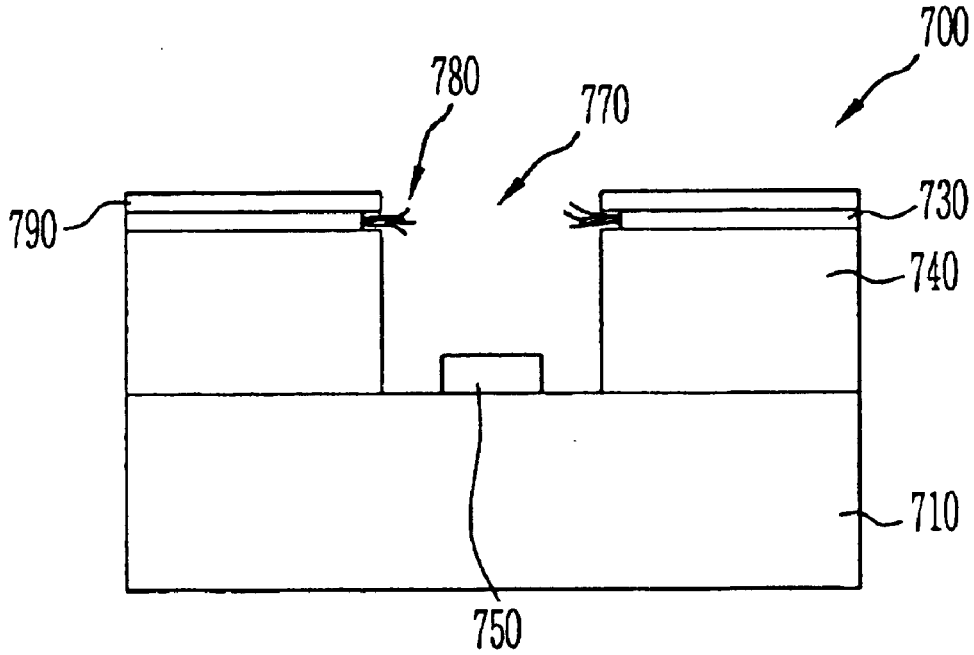

Referring now to FIG. 7, a dielectric layer 740, a catalytic layer 730 and a cathode electrode 790 are sequentially stacked on a lower substrate 710. The cathode electrode 790, the catalytic layer 730 and the dielectric layer 740 at a given region are etched to form a gate hole 770 through which the lower substrate 710 is exposed. A gate electrode 750 is formed at a given region of the exposed lower substrate 710 and an emitter 780 is also formed at the side wall of the catalytic layer 730 exposed through the gate hole 770, thus completing the cathode 700 for the field emission device according to a fifth embodiment of the present invention.

The catalytic layer 730 is formed of any one of the transition metals such as Fe, Co and Ni or an alloy or a compound of them and is formed in thickness of 20 nanometer (nm)~5 micron. Meanwhile, the gate hole 770 may have a given shape, preferably rectangular.

A cathode for a field emission device according to a sixth embodiment of the present invention will be below described by reference to FIG. 8.

Figure 8:
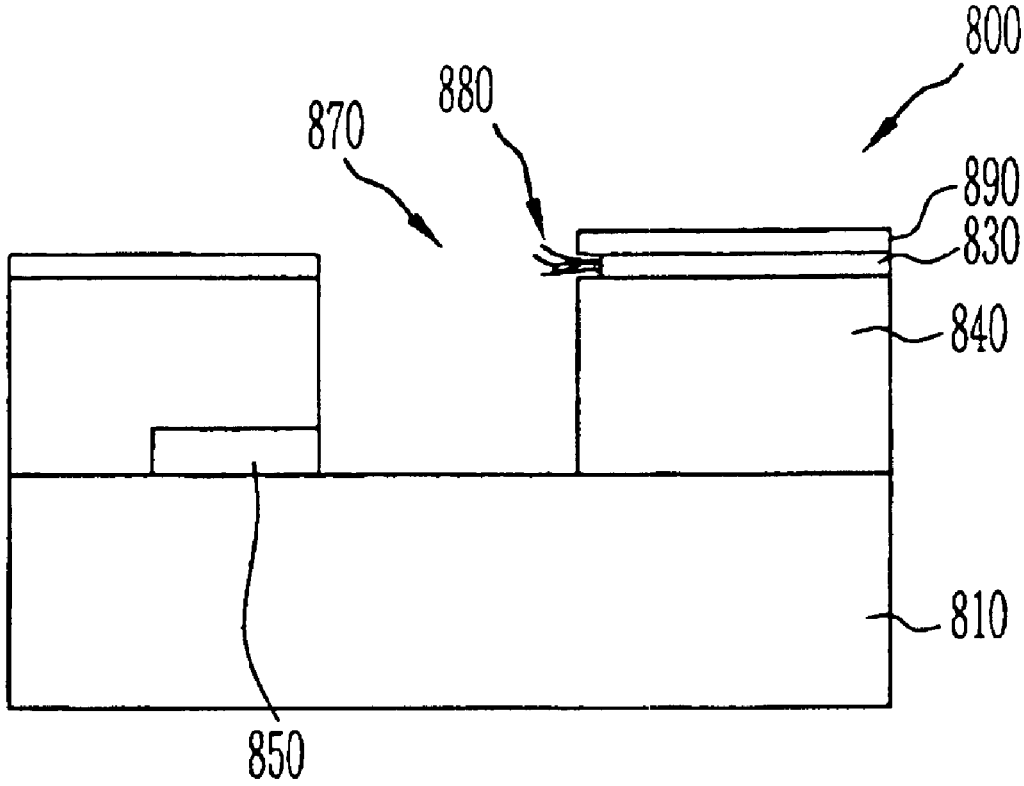

Referring now to FIG. 8, a dielectric layer 840, a catalytic layer 830 and a buffer layer 890 are sequentially stacked at one side of a lower substrate 810 and a gate electrode 850, the dielectric layer 840 and a buffer layer 890 are sequentially stacked on the other side of the lower substrate 810, centering around a gate hole 870. An emitter 880 is formed at the sidewall of the catalytic layer 830 exposed through the gate hole 870, thus completing the cathode 800 for the field emission device according to a sixth embodiment of the present invention.

As shown in FIG. 8, the catalytic layer 830 is formed only at a side facing the gate electrode 850 centering around the gate hole 870. Also, the gate electrode 850 is formed at an opposite side of the anode electrode (not shown) centering around the emitter 880.

In the above, the catalytic layer 830 is formed of any one of the transition metals such as Fe, Co and Ni or an alloy or a compound of them. Meanwhile, the gate hole 870 may have a given shape, preferably cylindrical or rectangular.

As the cathode 800 in FIG. 8 has the emitter 880 and the gate electrode 850 facing each other centering around the gate hole 870, it provides a triode-type cathode while minimizing a leakage current between the emitter 880 and the gate electrode 850. The cathode 800 having the structure of FIG. 8 can be manufactured by a similar method to that described in FIG. 2.

As above, the cathode for the field emission device according to the sixth embodiment of the present invention can minimize a leakage current between the emitter 880 and the gate electrode 850.

As mentioned above, the present invention includes forming an emitter at the sidewall of a catalytic layer exposed through a gate hole. Therefore, the present invention has advantages that it can control the shape of the emitter and also can easily control the amount of electrons emitted from the emitter using a voltage applied to a gate electrode with a little less affected by the anode voltage.

Further, the present invention includes forming the emitter having a good electron emission characteristic at a low electric field. Therefore, the present invention has advantages that it can reduce the size of the gate voltage for controlling the amount of electrons emitted from the emitter. In addition, the present invention can prohibit generation of a leakage current between the emitter and the gate electrode by forming the emitter and the gate electrode at a position facing each other, centering around the gate hole.

The present invention has been described with reference to a particular embodiment in connection with a particular application. Those having ordinary skill in the art and access to the teachings of the present invention will recognize additional modifications and applications within the scope thereof.

It is therefore intended by the appended claims to cover any and all such applications, modifications, and embodiments within the scope of the present invention.

What is claimed is:

1. A cathode for a field emission device comprising a catalytic layer, a dielectric layer and a gate electrode on a substrate, an emitter, gate hole exposing said substrate, and a buffer layer formed on the exposed surface of said gate electrode, wherein said emitter is formed at the sidewall of said catalytic layer exposed through said gate hole.

2. The cathode for a field emission device as claimed in claim 1, wherein said gate electrode and said catalytic layer are located at opposite sides centering around said gate hole.

3. The cathode for a field emission device as claimed in claim 2, wherein said gate electrode and said catalytic layer are located at different heights.

4. The cathode for a field emission device as claimed in claim 1, wherein said gate electrode located to said substrate nearer than said emitter.

5. The cathode for a field emission device as claimed in claim 1, wherein said emitter is made of any one of carbon nanotube, carbon nanoparticles and diamond with defects, using carbon as a major component.

6. The cathode for a field emission device as claimed in claim 1, wherein said catalytic layer is made of one of transition metals such as Fe, Co and Ni, or an alloy or a compound of said transition metals.

7. The cathode for a field emission device as claimed in claim 1, wherein said catalytic layer is used as a cathode electrode.

8. The cathode for a field emission device as claimed in claim 1, further including a cathode electrode formed between said catalytic layer and said dielectric layer.

* * * * *